US010741111B2

(12) United States Patent
Hong

(10) Patent No.: US 10,741,111 B2
(45) Date of Patent: Aug. 11, 2020

(54) CIRCUIT AND METHOD FOR DETECTING PIXEL POTENTIAL OF A DISPLAY PANEL, AND A DISPLAY PANEL

(71) Applicant: Wuhan China Star Optoelectronics Technology Co., Ltd., Wuhan, Hubei (CN)

(72) Inventor: Guanghui Hong, Hubei (CN)

(73) Assignee: WUHAN CHINA STAR OPTOELECTRONICS TECHNOLOGY CO., LTD., Wuhan (CN)

( * ) Notice: Subject to any disclaimer, the term of this patent is extended or adjusted under 35 U.S.C. 154(b) by 107 days.

(21) Appl. No.: 15/749,422

(22) PCT Filed: Jan. 4, 2018

(86) PCT No.: PCT/CN2018/071259
§ 371 (c)(1),
(2) Date: Nov. 6, 2018

(87) PCT Pub. No.: WO2019/114054
PCT Pub. Date: Jun. 20, 2019

(65) Prior Publication Data

US 2020/0135070 A1 Apr. 30, 2020

(30) Foreign Application Priority Data

Dec. 12, 2017 (CN) ..... 2017 1 1322422

(51) Int. Cl.
*G09G 3/00* (2006.01)
*G09G 3/36* (2006.01)

(52) U.S. Cl.
CPC ..... *G09G 3/006* (2013.01); *G09G 3/36* (2013.01); *G09G 2300/0439* (2013.01); *G09G 2310/0291* (2013.01); *G09G 2310/08* (2013.01)

(58) Field of Classification Search
CPC ..... G09G 3/00; G09G 3/006; G09G 3/36; G09G 2300/0439; G09G 2310/08; G09G 2310/0291
See application file for complete search history.

(56) References Cited

U.S. PATENT DOCUMENTS 9,177,497 B2 * 11/2015 Li ..... G09G 3/006
2001/0040565 A1 * 11/2001 Koyama ..... G09G 3/3233 345/204

(Continued)

FOREIGN PATENT DOCUMENTS

JP 2008052111 A * 3/2008
JP 2009229635 A * 10/2009

*Primary Examiner* — Son T Le
(74) *Attorney, Agent, or Firm* — Hemisphere Law, PLLC; Zhigang Ma

(57) ABSTRACT

A circuit and method for detecting pixel potential of a display panel and a display panel is provided. The circuit comprises a multiplexed output selector, at least one detection circuit and at least one signal amplifier. The detection circuit comprises a first TFT receiving a test signal and being connected to the multiplexed output selector. The multiplexed output selector is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier. The signal amplifier is configured to receive and amplify the (Continued)

test signal to obtain and output a received signal. The present disclosure is able of measuring real pixel potential of the display panel.

14 Claims, 8 Drawing Sheets

(56) References Cited

U.S. PATENT DOCUMENTS

2008/0048709 A1* 2/2008 Lee ..... G09G 3/006
324/760.02
2012/0092037 A1* 4/2012 Yu ..... H01L 22/14
324/762.01

* cited by examiner

CIRCUIT AND METHOD FOR DETECTING PIXEL POTENTIAL OF A DISPLAY PANEL, AND A DISPLAY PANEL

RELATED APPLICATIONS

The present application is a National Phase of International Application Number PCT/CN2018/071259, filed Jan. 4, 2018, and claims the priority of China Application No. 201711322422.0, filed Dec. 12, 2017.

FIELD OF THE DISCLOSURE

The disclosure relates to a display technical field, and more particularly to a circuit and method for detecting pixel potential of a display panel, and a display panel.

BACKGROUND

The design of an AA area (effective display area) and pixel driving circuit (as shown in FIG. 1) in a display panel usually used nowadays comprises Gate lines (i.e., gate lines), Data lines (i.e., first data lines), sub-pixel units and multiplexing circuits. The Gate lines are used for realizing line-by-line scanning of the sub-pixel units in the AA area, the data lines are used for charging the sub-pixel units in the AA area, and the multiplexing circuits are used for realizing multiplexed output selection of the Data lines in the display panel. The display panel drives rotation of liquid crystals through the potential of the sub-pixel units to realize the different transmittances required for displaying different images on the display panel, so that the real potentials of the sub-pixel units in the display panel is an important index. However, the real potentials of the sub-pixel units in the display panel cannot be measured by the panel designing solutions provided nowadays. Therefore, during the process such as problem analyzing, the real potential of the sub-pixel units cannot be actually measured by the designing solutions. Because there is no structure designed in the designing solutions provided nowadays for measuring the real potential in the sub-pixel units, the real potential of the sub-pixel units, i.e., the real pixel potential, cannot be accurately obtained.

SUMMARY

In order to solve the problem mentioned above, the present disclosure provides a circuit and method for detecting pixel potential of a display panel and a display panel to measure real pixel potential of the display panel.

The present disclosure provides a circuit for detecting pixel potential of a display panel, comprising a multiplexed output selector, at least one detection circuit and at least one signal amplifier; wherein, the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal;

the first terminal of each the first TFT of the circuit for detecting a pixel potential of the display panel is one of a source terminal and a drain terminal, the second terminal of each the first TFT is another one of the source terminal and the drain terminal, and the third terminal of each the first TFT is a gate terminal.

In one embodiment, the multiplexed output selector comprises N reverse clock signal line sets and a plurality of second TFT's connecting to the first data line of the display panel, respectively, and each reverse clock signal line set comprises three reverse clock signal lines;

every adjacent 3*N second TFT's in the display panel are connected to different reverse clock signal lines of the N reverse clock signal line sets, respectively;

each the first TFT is correspondingly connected to adjacent 3*N second TFT's;

wherein, N≥1, a first terminal of each of the second TFT's is connected to the third terminal of the first TFT, a second terminal of each of the second TFT's is connected to the first data line of the display panel, and a third terminal of each of the second TFT's is connected to one of the reverse clock signal lines.

In one embodiment, an amount of the first data line of the display panel is set to M, an amount of the detection circuit and an amount of the signal amplifier are both smallest integers greater than or equal to M/(3*N) and the first TFT is connected one-by-one to the signal amplifier.

In one embodiment, each first TFT and the second TFT's are N-channel TFT's.

In one embodiment, the circuit for detecting pixel potential of the display panel further comprises a signal analyzing module; wherein the signal analyzing module is connected to the signal amplifier, and is configured to receive the received signal output from the signal amplifier and determine a pixel potential of the currently-detected sub-pixel unit in accordance with a strength of the received signal.

The present disclosure further provides a display panel, comprising a pixel driving circuit and a circuit for detecting a pixel potential of the display panel; wherein the circuit for detecting the pixel potential of the display panel comprises a multiplexed output selector, at least one detection circuit and at least one signal amplifier;

the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal; the pixel driving circuit comprises a plurality of first data lines, a plurality of gate lines and three sub-pixel on/off control signal lines, and the first data lines are crossed with the gate lines to form a matrix structure; and a square area defined by adjacent two of the first data lines and adjacent two of the gate lines is a sub-pixel unit, each the sub-pixel unit comprises a pixel TFT, a first terminal of the pixel TFT is connected to a selected one of the first data lines which is adjacent to the pixel TFT, a third terminal of the pixel TFT is connected to a selected one of the gate lines which is adjacent to the pixel TFT, and at most one pixel TFT is simultaneously connected to the crossed first data line and scan line;

each of the first data lines is connected to one of the sub-pixel on/off control signal lines through a third TFT, and every adjacent three of the first data lines are connected to different three of the sub-pixel on/off control signal lines, respectively;

wherein, a third terminal of the third TFT is connected to one of the sub-pixel on/off control signal lines, a first terminal of the third TFT is connected to one of the first data lines, and three second terminals of adjacent three of the third TFT's are connected to a second data line; each of the first terminals of the TFT's of the circuit for detecting the pixel potential of the display panel and the pixel driving circuit is one of a source terminal and a drain terminal, each of the second terminals of the TFT's is another one of the source terminal and the drain terminal; and each of the third terminals of the TFT's is a gate terminal.

In one embodiment, the TFT's of the pixel driving circuit are N-channel TFT's.

In one embodiment, when the display panel functions, the reverse clock signal used in the circuit for detecting the pixel potential of the display panel is at low potential.

In one embodiment, the multiplexed output selector comprises N reverse clock signal line sets and a plurality of second TFT's connecting to the first data line of the display panel, respectively, and each reverse clock signal line set comprises three reverse clock signal lines;

every adjacent 3*N second TFT's in the display panel are connected to different reverse clock signal lines of the N reverse clock signal line sets, respectively;

each the first TFT is correspondingly connected to adjacent 3*N second TFTs;

wherein, N≥1, a first terminal of each of the second TFT's is connected to the third terminal of the first TFT, a second terminal of each of the second TFT's is connected to the first data line of the display panel, and a third terminal of each of the second TFT's is connected to one of the reverse clock signal lines.

In one embodiment, an amount of the first data line of the display panel is set to M, an amount of the detection circuit and an amount of the signal amplifier are both smallest integers greater than or equal to M/(3*N) and the first TFT is connected one-by-one to the signal amplifier.

In one embodiment, the first TFT's and the second TFT's are all N-channel TFT's.

In one embodiment, the display panel further comprises a signal analyzing module; wherein the signal analyzing module is connected to the signal amplifier, and is configured to receive the received signal output from the signal amplifier and determine a pixel potential of the currently-detected sub-pixel unit in accordance with a strength of the received signal.

The present disclosure further provides a method for detecting pixel potential of a display panel, which is applied in the display panel, wherein the display panel comprises a pixel driving circuit and a circuit for detecting a pixel potential of the display panel;

the circuit for detecting the pixel potential of the display panel comprises a multiplexed output selector, at least one detection circuit and at least one signal amplifier;

the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal; the pixel driving circuit comprises a plurality of first data lines, a plurality of gate lines and three sub-pixel on/off control signal lines, and the first data lines are crossed with the gate lines to form a matrix structure; and a square area defined by adjacent two of the first data lines and adjacent two of the gate lines is a sub-pixel unit, each the sub-pixel unit comprises a pixel TFT, a first terminal of the pixel TFT is connected to a selected one of the first data lines which is adjacent to the pixel TFT, a third terminal of the pixel TFT is connected to a selected one of the gate lines which is adjacent to the pixel TFT, and at most one pixel TFT is simultaneously connected to the crossed first data line and scan line;

each of the first data lines is connected to one of the sub-pixel on/off control signal lines through a third TFT, and every adjacent three of the first data lines are connected to different three of the sub-pixel on/off control signal lines, respectively;

wherein, a third terminal of the third TFT is connected to one of the sub-pixel on/off control signal lines, a first terminal of the third TFT is connected to one of the first data lines, and three second terminals of adjacent three of the third TFT's are connected to a second data line; each of the first terminals of the TFT's of the circuit for detecting the pixel potential of the display panel and the pixel driving circuit is one of a source terminal and a drain terminal, each of the second terminals of the TFT's is another one of the source terminal and the drain terminal, and each of the third terminals of the TFT's is a gate terminal;

the method for detecting pixel potential of the liquid crystal comprises steps of:

turning off the pixel TFT's except the pixel TFT of the currently-detected sub-pixel unit of the display panel through the gate lines and a sub-pixel control signal; and transmitting a potential signal of the currently-detected sub-pixel unit to the first TFT by controlling the multiplexed output selector by the reverse clock signal;

controlling, by the potential signal of the currently-detected sub-pixel unit, the first TFT to transmit the test signal to the signal amplifier;

amplifying the test signal by the signal amplifier to obtain the received signal; and determining a pixel potential of the currently-detected sub-pixel unit in accordance with the received signal.

In one embodiment, when the display panel comprises the circuit for detecting pixel potential of the display panel as claimed in claim 4, step of turning off the pixel TFT's except the pixel TFT of the currently-detected sub-pixel unit of the display panel through the gate lines and the sub-pixel control signal, and transmitting the potential signal of the currently-detected sub-pixel unit to the first TFT by controlling the multiplexed output selector by the reverse clock signal comprises:

controlling a selected one of the gate lines connected to the pixel TFT of the currently-detected sub-pixel unit to be at high potential, and the gate lines except the selected gate line to be at low potential;

controlling a selected one of the reverse clock signal lines connected to the pixel TFT of the currently-detected sub-pixel unit to be at high potential, and the reverse clock signal lines except the selected reverse clock signal line to be at low potential; and controlling the sub-pixel control signal on each of the three sub-pixel on/off control signal lines to be at low potential.

The beneficial effects obtained through implementing the present disclosure are as follows: the real potential of the sub-pixel unit of the display panel can be estimated in accordance with the strength of the received signal through selectively conducting, by the multiplexed output selector, the first data line connected to the currently-detected sub-pixel unit to the first TFT, transmitting the pixel potential signal of the currently-detected sub-pixel unit to the first TFT, and amplifying the test signal to obtain the received signal by the signal amplifier.

BRIEF DESCRIPTION OF THE DRAWINGS

In order to make the descriptions of the technique solutions of the embodiments of the present disclosure or the existed techniques, the drawings necessary for describing the embodiments or the existed techniques are briefly introduced below. Obviously, the drawings described below are only some embodiments of the present disclosure, and, for those with ordinary skill in this field, other drawings can be obtained from the drawings described below without creative efforts.

DETAILED DESCRIPTION OF PREFERRED EMBODIMENTS

The present disclosure provides a circuit for detecting a pixel potential of a display panel. As showing in FIG. 2, the circuit for detecting the pixel potential of the display panel comprises a multiplexed output selector 110, at least one detection circuit 120 and at least one signal amplifier 130.

The detection circuit 120 comprises a first thin film transistor (TFT) NT1, The first terminal of the first TFT NT1 receives a test signal, the second terminal of the first TFT NT1 is connected to the signal amplifier 130, and the third terminal of the first TFT NT1 is connected to the multiplexed output selector 110.

Figure 1:
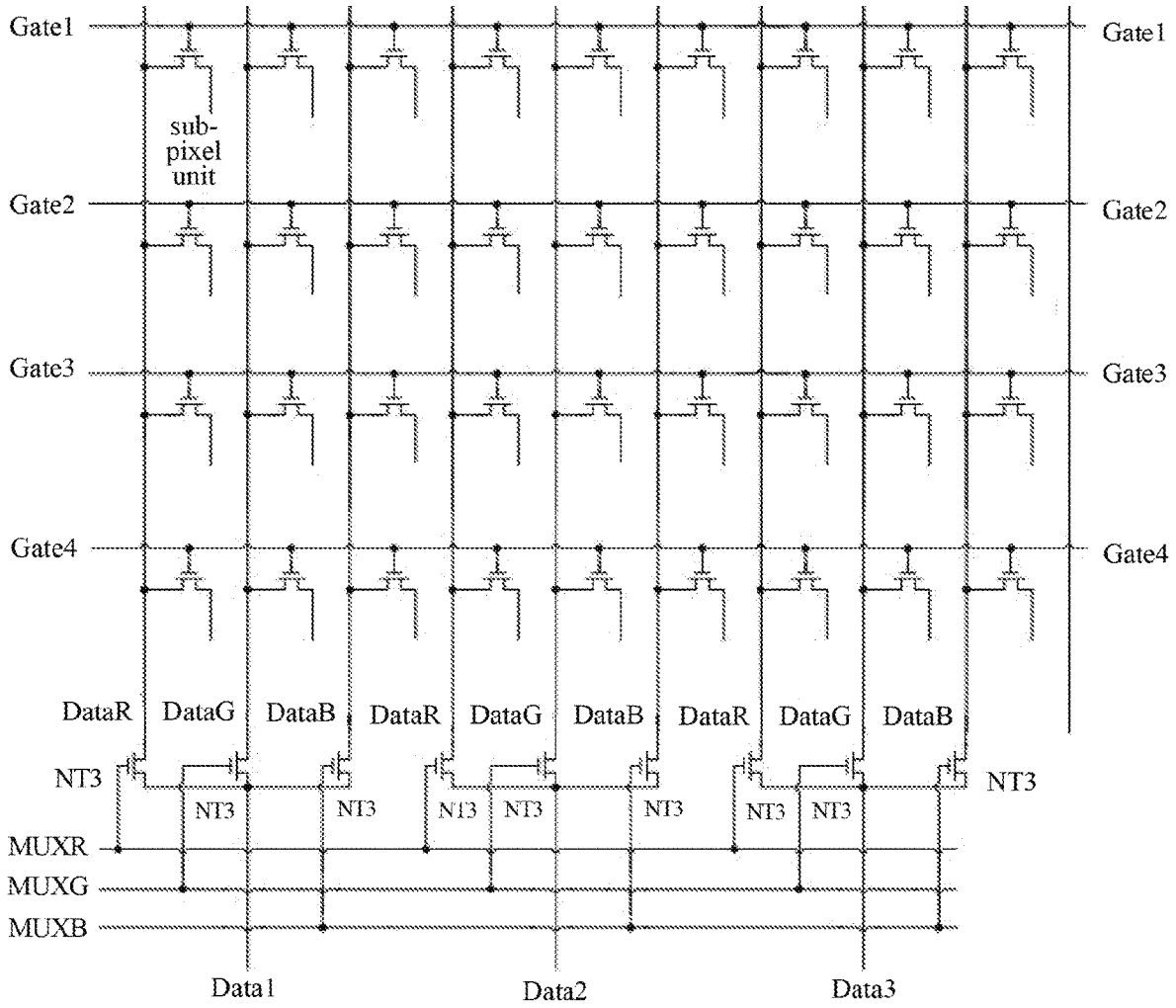
FIG. 1 is a schematic diagram of the pixel driving circuit in the AA area provided in the present disclosure.
Figure 2:
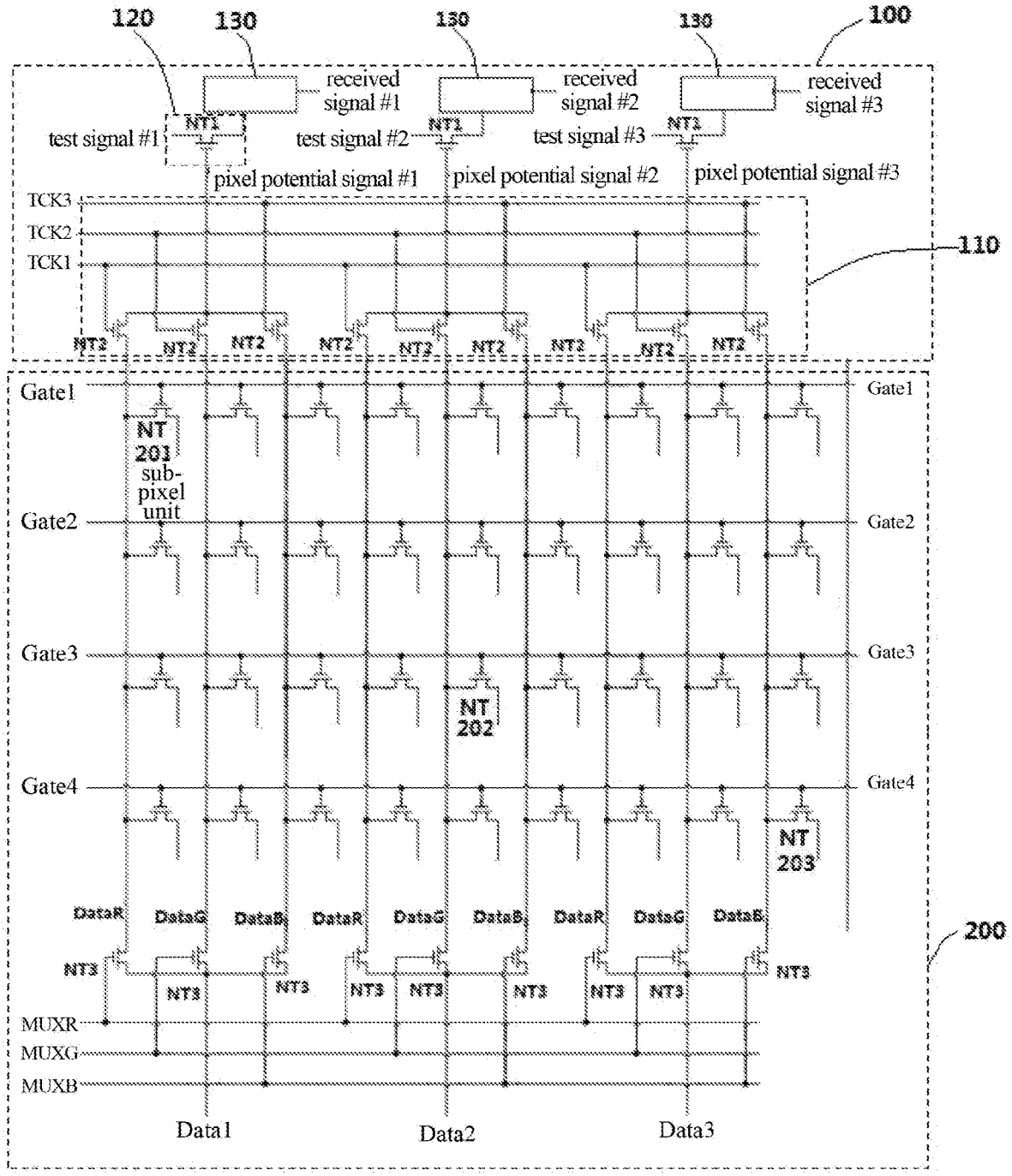
FIG. 2 is a schematic diagram of a circuit for detecting the pixel potential of the display panel according to the first embodiment of the present disclosure.
Figure 3:
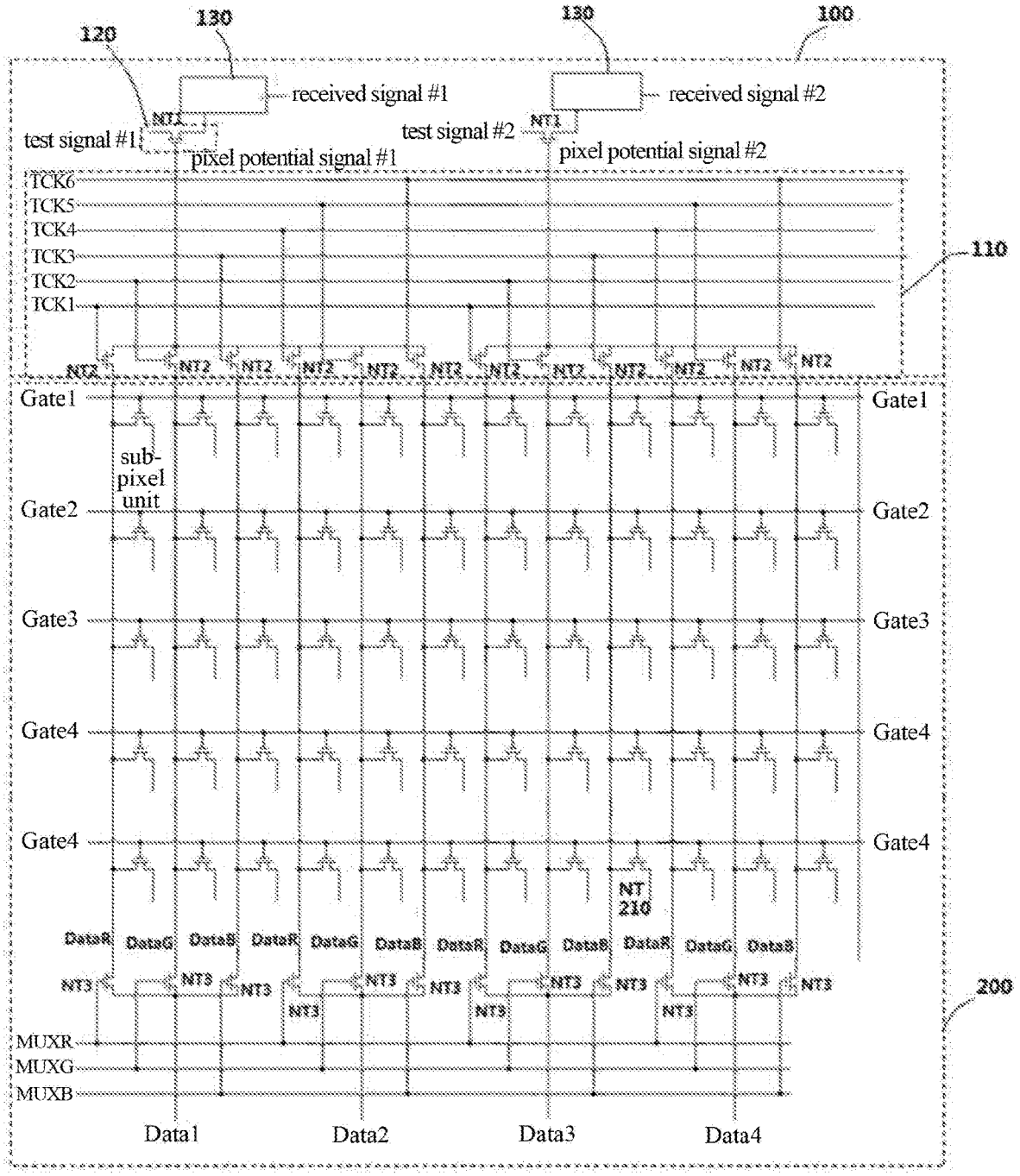
FIG. 3 is a schematic diagram of a circuit for detecting the pixel potential of the display panel according to the second embodiment of the present disclosure.

The multiplexed output selector 110 is connected to the first data lines (the first data lines are the data lines connected to the sub-pixel units, such as DataR, DataG, DAtaB shown in FIG. 2 and FIG. 3), and the detection circuit 120. The multiplexed output selector 110 is configured to selectively conducting the first data line connected to the currently-detected sub-pixel unit to the first TFT NT1 in accordance with the reverse clock signal, so that the pixel potential signal of the currently-detected sub-pixel unit is transmitted to the first TFT NT1 to control the first TFT NT1 to transmit the test signal to the signal amplifier 130.

The signal amplifier 130 is configured to receive and amplify the test signal so that the test signal is converted to be the received signal and output the received signal.

In the circuit for detecting the pixel potential of the display panel, the first terminal of the TFT is one of the source terminal and drain terminal, the second terminal is another one of the source terminal and drain terminal, and the third terminal is the gate terminal.

In one embodiment, the multiplexed output selector 110 comprises N reverse clock signal line sets and a plurality of second TFT's NT2 correspondingly connecting to the first data line of the display panel, respectively, and each reverse clock signal line set comprises three reverse clock signal lines. Generally, an amount of the second TFT NT2 is corresponded and equal to the amount of the first data line in the AA area (i.e., the effective display area) of the display panel. In the first embodiment as shown in FIG. 2, the multiplexed output selector 110 comprises one reverse clock signal line set, that is, total three reverse clock signal lines TCK1, TCK2 and TCK3, respectively. In the second embodiment as shown in FIG. 3, the multiplexed output selector 110 comprises two reverse clock signal line sets, that is, total six reverse clock signal lines TCK1, TCK2, TCK3, TCK4, TCK5 and TCK6, respectively.

Every adjacent 3*N second TFT's NT2 in the display panel are connected to different reverse clock signal lines of the N reverse clock signal line sets, respectively. For example, there are three reverse clock signal lines in the multiplexed output selector 110, the first one of the first data lines in the AA area is connected to the first reverse clock signal line TCK1, the second one of the first data lines is connected to the second reverse clock signal line TCK2, the third one of the first data lines is connected to the third reverse clock signal line TCK3, the fourth one of the first data lines is connected to the first reverse clock signal line TCK1, the fifth one of the first data lines is connected to the second reverse clock signal line TCK2, and the sixth one of the first data lines is connected to the third reverse clock signal line TCK3.

Each first TFT NT1 is correspondingly connected to adjacent 3*N second TFT's NT2. For example, when N=1 and counting from left or right side of FIG. 2, the first one of the first TFT's NT1 is connected to the first one to third one of the second TFT's NT2, the second one of the first TFT's NT1 is connected to the fourth one to sixth one of the second TFT's NT2, and the kth one of the first TFT's NT1 is connected to the (3 k−2)th one to (3 k)th one of the second TFT's NT2. When N=2 and counting from left or right side of FIG. 3, the first one of the first TFT's NT1 is connected to the first one to sixth one of the second TFT's NT2, and the second one of the first TFT's NT2 is connected to the seventh one to twelfth one of the second TFT's NT2.

Wherein, N≥1, the first terminal of the second TFT NT2 is connected to the third terminal of the first TFT NT1, the second terminal of the second TFT NT2 is connected to one of the first data lines of the display panel, and the third terminal of the second TFT NT2 is connected to one of the reverse clock signal lines.

In one embodiment, an amount of the first data line of the display panel is set to M, and M is a positive integer. Accordingly, an amount of the detection circuit 120 and an amount of the signal amplifier 130 are both the smallest integer greater than or equal to M/(3*N), and the first TFT's NT1 is connected one-by-one to the signal amplifiers 130, For example, when M=1980 and N=1, the smallest integer greater than or equal to M/(3*N) is 660.

In one embodiment, the first TFT's NT1 and the second TFT's NT2 are N-channel TFT's.

Figure 4:
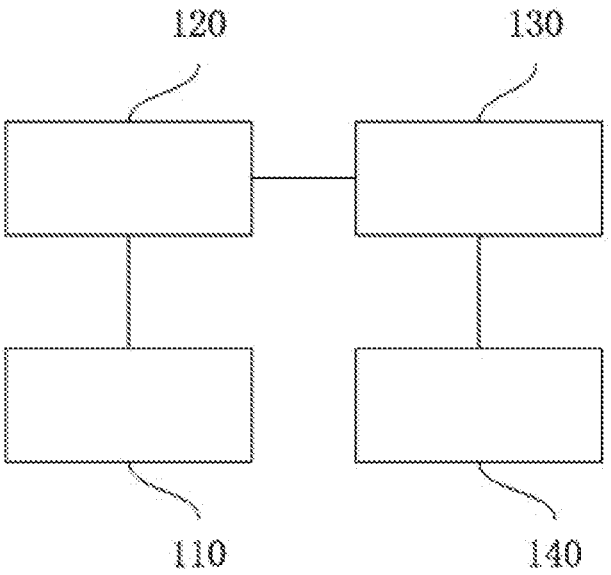
FIG. 4 is a schematic diagram of a circuit for detecting the pixel potential of the display panel according to the third embodiment of the present disclosure.

In one embodiment, as shown in FIG. 4, the circuit for detecting pixel potential of the display panel further comprises a signal analyzing module 140. The signal analyzing module 140 is connected to the signal amplifier 130, and is configured to receive the received signal output from the signal amplifier 130 and determine a pixel potential of the currently-detected sub-pixel unit in accordance with a strength of the received signal.

Figure 5A:
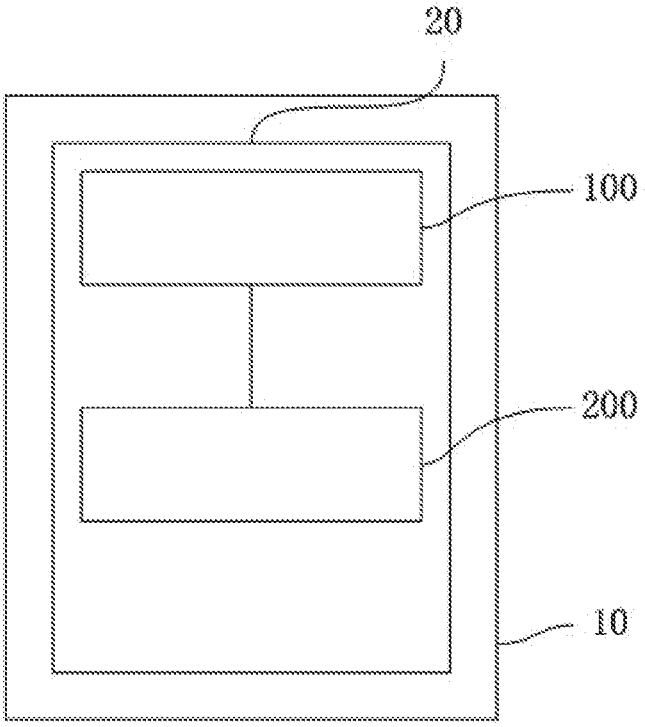
FIG. 5*a* is a schematic diagram of the display panel according to one embodiment of the present disclosure.
Figure 5B:
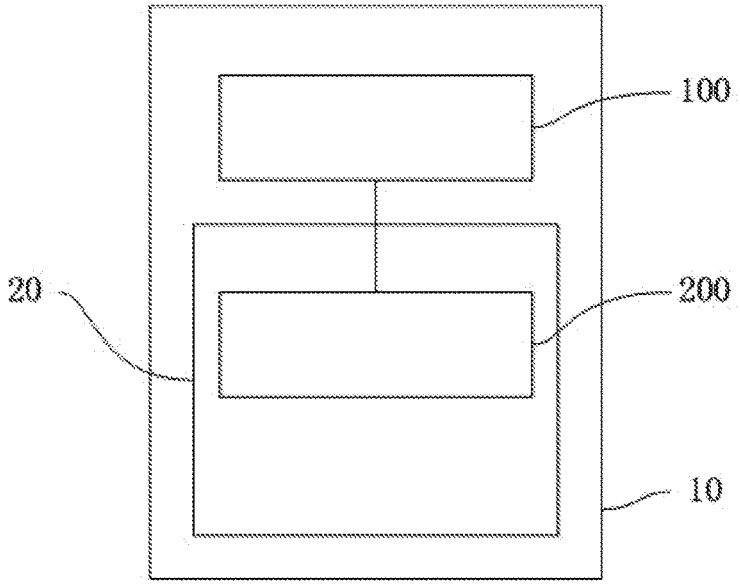
FIG. 5*b* is a schematic diagram of the display panel according to another embodiment of the present disclosure.

The present disclosure further provides a display panel. As shown in FIG. 5*a* and FIG. 5*b*, the display panel 10 comprises a pixel driving circuit 200 and the circuit 100 described above for detecting the pixel potential of the display panel. The first data lines are crossed with the gate lines to form a matrix structure. A square area defined by adjacent two first data lines and adjacent two gate lines is a sub-pixel unit described above. Each sub-pixel unit comprises a pixel TFT, a first terminal of the pixel TFT is connected to a selected one of the first data lines which is adjacent to the pixel TFT, a third terminal of the pixel TFT is connected to a selected one of the gate lines which is adjacent to the pixel TFT, and at most one pixel TFT is simultaneously connected to the crossed first data line and scan line, that is, different two pixel TFT's cannot be connected to a same set of the crossed first data line and scan line at the same time.

Each first data line is connected to one of the sub-pixel on/off control signal lines through a third TFT NT3, and every adjacent three first data lines are connected to different three sub-pixel on/off control signal lines, respectively. The different three sub-pixel on/off control signal lines are the red sub-pixel on/off control signal line, the green sub-pixel on/off control signal line and the blue sub-pixel on/off control signal line, respectively.

In one embodiment, the third terminal of the third TFT NT3 is connected to one of the sub-pixel on/off control signal lines, the first terminal of the third TFT NT3 is connected to one of the first data lines, and three second terminals of adjacent three third TFT's NT3 are connected to a same one of the second data lines (such as the Data1, Data2 and Data 3 shown in FIG. 2 and FIG. 3). In the pixel driving circuit 200, the first terminal of each TFT is one of the source terminal and drain terminal, the second terminal of each TFT is another one of the source terminal and drain terminal, and the third terminal is the gate terminal.

In one embodiment, the TFT's of the pixel driving circuit 200 are N-channel TFT's.

In one embodiment, when the display panel functions, the reverse clock signals used in the circuit 100 for detecting the pixel potential of the display panel are all at low potential VGL.

The present disclosure further provides a method for detecting pixel potential of display panel applied in the display panel described above. The method comprises steps of:

turning off the pixel TFT's of the display panel except the pixel TFT of the currently-detected sub-pixel unit through the gate lines and a sub-pixel control signal, and transmitting a potential signal of a currently-detected pixel to the first TFT NT1 by controlling the multiplexed output selector by the reverse clock signal, wherein the potential signal of the currently-detected pixel is also the potential signal of the currently-detected sub-pixel unit;

controlling, by the potential signal of the currently-detected pixel, the first TFT NT1 to transmit the test signal to the signal amplifier 130;

amplifying the test signal by the signal amplifier 130 to obtain the received signal; and determining the potential of the currently-detected pixel in accordance with the received signal, wherein the potential of the currently-detected pixel is also the potential of the currently-detected sub-pixel unit.

In one embodiment, the step of turning off the pixel TFT's except the pixel TFT of the currently-detected sub-pixel unit of the display panel through the gate lines and the sub-pixel control signal, and transmitting the potential signal of the currently-detected pixel to the first TFT by controlling the multiplexed output selector by the reverse clock signal comprises:

controlling a selected one of the gate lines connected to the pixel TFT of the currently-detected sub-pixel unit to be at high potential, and the gate lines except the selected gate line to be at low potential;

controlling a selected one of the reverse clock signal lines connected to the pixel TFT of the currently-detected sub-pixel unit to be at high potential, and the reverse clock signal lines except the selected reverse clock signal line to be at low potential; and controlling the sub-pixel control signal on each of the three sub-pixel on/off control signal lines to be at low potential.

In the first embodiment as shown in FIG. 2, the multiplexed output selector 110 comprises three reverse clock signal lines TCK1, TCK2 and TCK3, and the potential signal of the sub-pixel unit (i.e., the potential signal of the pixel) of the display panel is transmitted to the detection circuit 120 through controlling turning on/off of the second TFT's NT2 by using the reverse clock signals on the reverse clock signal lines TCK1, TCK2 and TCK3, controlling the gate lines Gate1, Gate2, Gate 3 and Gate 4 by using GOA (Gate Driver on Array) circuit, and controlling turning on/off of the third TFT's NT3 by using the red sub-pixel on/off control signal line MUXR, the green sub-pixel on/off control signal line MUXG, and the blue sub-pixel on/off control signal line MUXB. That is, the potential signal of the pixel is transmitted to the corresponded first TFT NT1 to drive the first TFT NT1 to transmit the test signal to the signal amplifier 130. The signal amplifier 130 amplifies the test signal so that the test signal is converted into the received signal, and the real potential of the sub-pixel unit of the display panel is estimated in accordance with the strength of the received signal.

Figure 6:
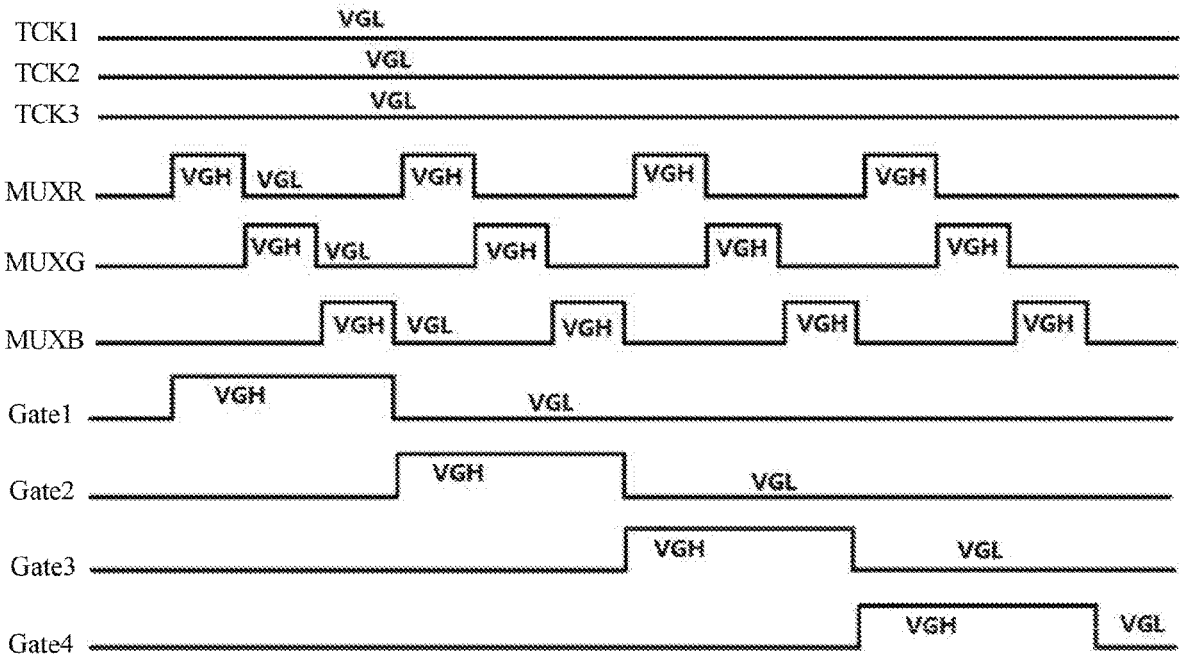
FIG. 6 is a timing sequence of the display panel when the display panel functions normally in the first embodiment of the present disclosure.

As shown in FIG. 6, which is a timing sequence of the display panel when the display panel functions normally, and, specifically, a timing sequence of the pixel driving circuit 200 of the AA area of the display panel. In order to prevent the normal function of the display panel from being affected by the circuit of the multiplexed output selector 110, the reverse clock signals on the reverse clock signal line TCK1, TCK2 and TCK3 are kept at low potential VGL so that the circuit of the multiplexed output selector 110 is not functioned while the display panel is normally driven. At the same time, the potentials of the gate lines Gate1, Gate 2, Gate 3 and Gate 4 are changed to be high potential in sequence to turn on the sub-pixel units line-by-line sequentially. Furthermore, the red sub-pixel on/off control signal line MUXR, the green sub-pixel on/off control signal line MUXG and the blue sub-pixel on/off control signal line MUXB are set at high potential VGH in sequence to provide potential to the first data lines DataR, DataG and DataB to charge the sub-pixel units of the display panel to drive the rotation of the liquid crystal.

Figure 7:
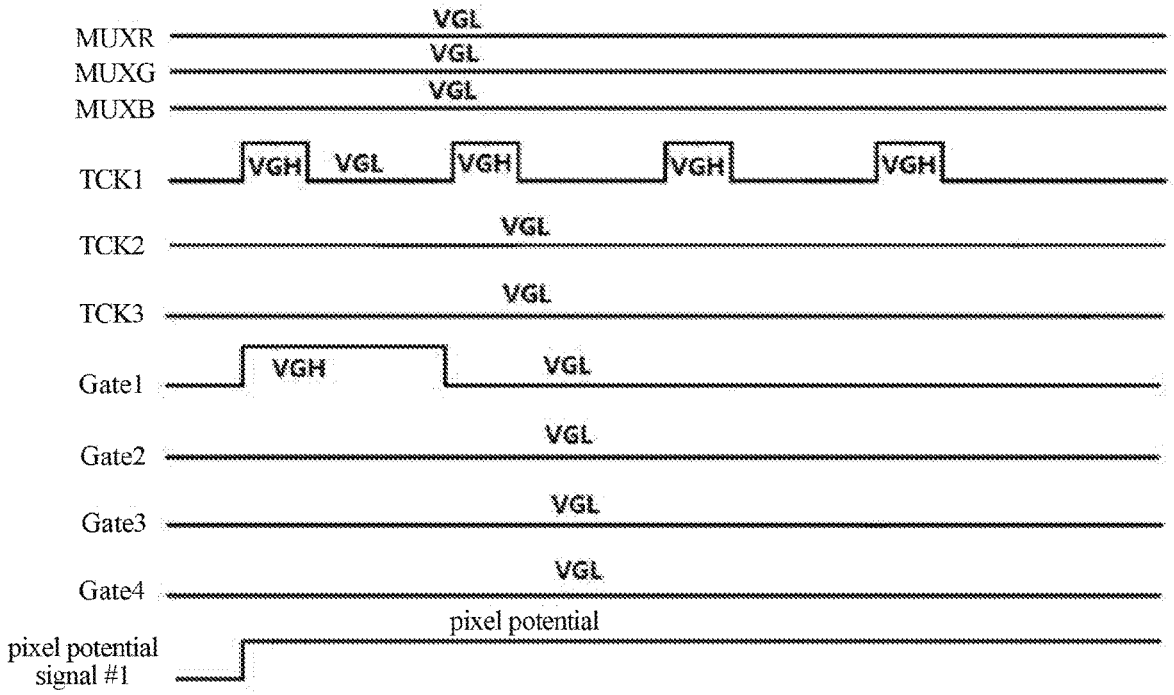
FIG. 7 is a timing sequence of the display panel when the pixel potential of the pixel thin film transistor NT201 is detected in the first embodiment of the present disclosure.

As shown in FIG. 7, which is a timing sequence of the display panel when the pixel potential of the pixel TFT NT201 is detected in the first embodiment of the present disclosure. In order to understand the real potential of the sub-pixel unit comprising the pixel TFT NT201 in FIG. 2, the low potential VGL is provided to the gate lines Gate2, Gate3 and Gate4 and the sub-pixel on/off control signal lines MUXR, MUXG and MUXB, and the gate line Gate 1 is turned on (i.e., provided with the high potential VGH) alone in the first. At this time, the reverse clock signal line TCK1 of the multiplexed output selector 110 is at high potential VGH and the reverse clock signal lines TCK2 and TCK3 are at low potential VGL, so that the potential of the sub-pixel unit corresponding to the pixel TFT NT201 in FIG. 2 is conducted, under the driving sequence, to the pixel potential signal #1 for driving the detection circuit 120 to work, so that the received test signal is converted to be the received signal by operation of the signal amplifier 130 and the real potential of the sub-pixel unit of the display panel is determined in accordance with the strength of the received signal.

Figure 8:
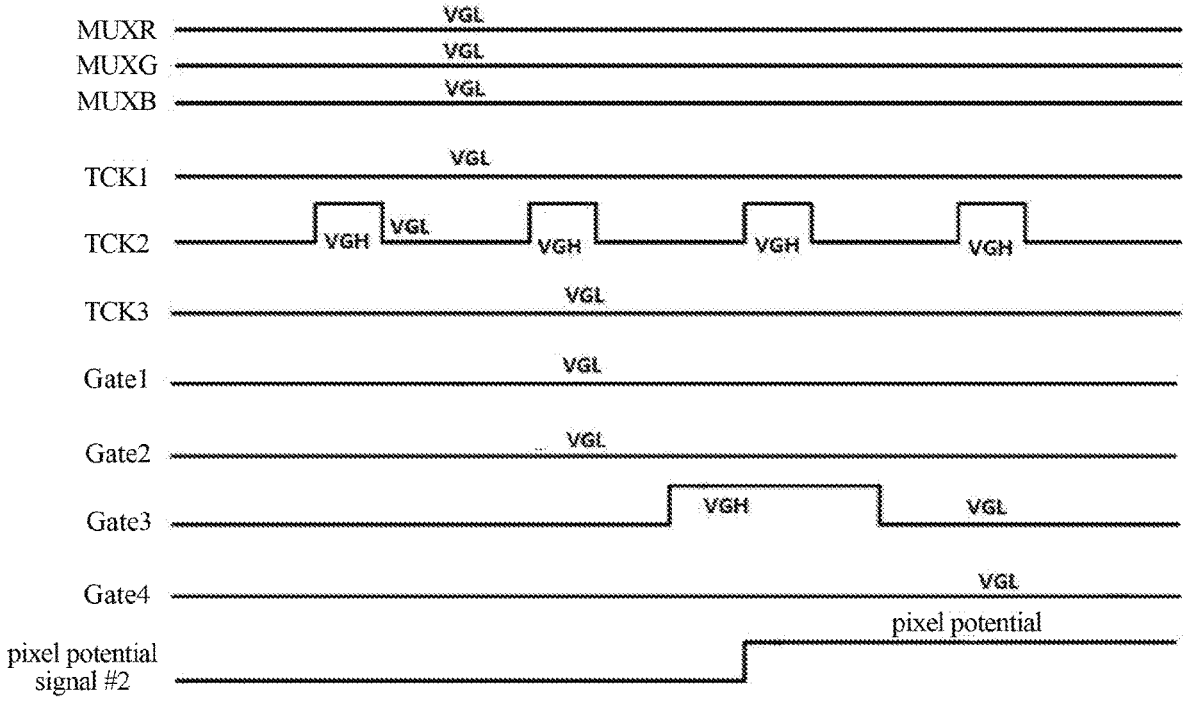
FIG. 8 is a timing sequence of the display panel when the pixel potential of the pixel thin film transistor NT202 is detected in the first embodiment of the present disclosure.

As shown in FIG. 8, which is a timing sequence of the display panel when the pixel potential of the pixel thin film transistor NT202 is detected in the first embodiment of the present disclosure. In order to understand the real potential of the sub-pixel unit comprising the pixel TFT NT202 in FIG. 2, the low potential VGL is provided to the gate lines Gate1, Gate2 and Gate4 and the sub-pixel on/off control signal lines MUXR, MUXG and MUXB, and the gate line Gate 3 is turned on alone in the first. At this time, the reverse clock signal line TCK2 of the multiplexed output selector 110 is at high potential VGH and the reverse clock signal lines TCK1 and TCK3 are at low potential VGL, so that the potential of the sub-pixel unit corresponding to the pixel TFT NT202 in FIG. 2 is conducted, under the driving sequence, to the pixel potential signal #2 for driving the detection circuit 120 to work, so that the received test signal is converted to be the received signal by operation of the signal amplifier 130 and the real potential of the sub-pixel unit of the display panel is determined in accordance with the strength of the received signal.

Figure 9:
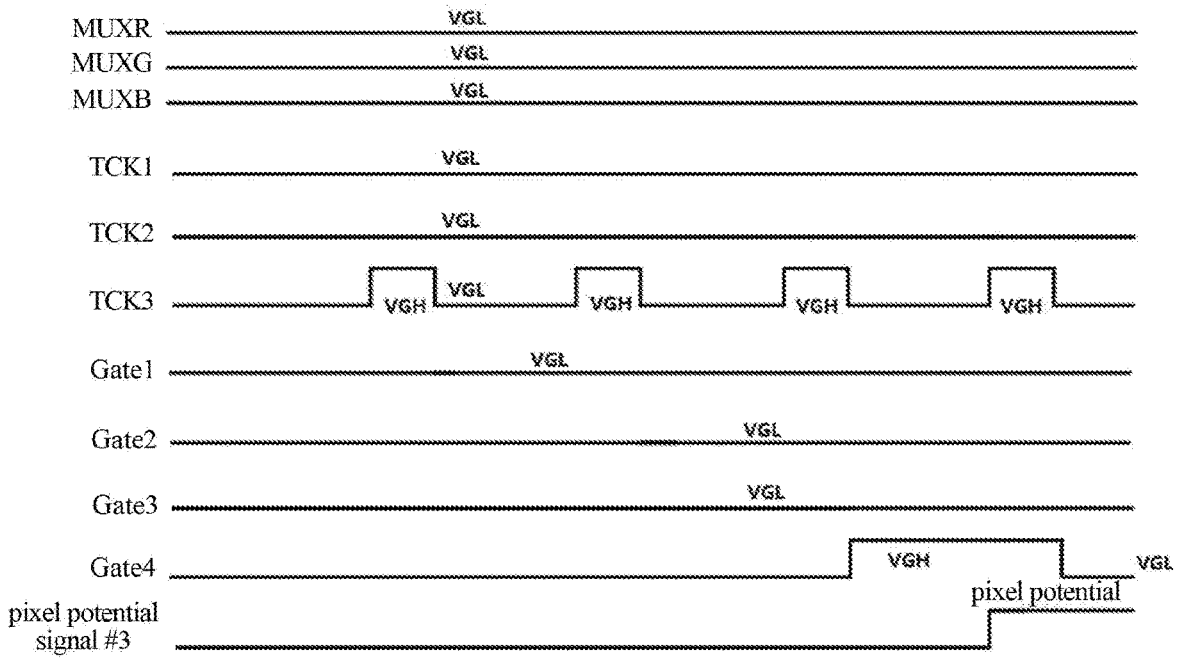
FIG. 9 is a timing sequence of the display panel when the pixel potential of the pixel thin film transistor NT203 is detected in the first embodiment of the present disclosure.

As shown in FIG. 9, which is a timing sequence of the display panel when the pixel potential of the pixel thin film transistor NT203 is detected in the first embodiment of the present disclosure. In order to understand the real potential of the sub-pixel unit comprising the pixel TFT NT203 in FIG. 2, the low potential VGL is provided to the gate lines Gate1, Gate2 and Gate3 and the sub-pixel on/off control signal lines MUXR, MUXG and MUXB, and the gate line Gate 4 is turned on alone in the first. At this time, the reverse clock signal line TCK3 of the multiplexed output selector 110 is at high potential VGH and the reverse clock signal lines TCK1 and TCK2 are at low potential VGL, so that the potential of the sub-pixel unit corresponding to the pixel TFT NT203 in FIG. 2 is conducted, under the driving sequence, to the pixel potential signal #3 for driving the detection circuit 120 to work, so that the received test signal is converted to be the received signal by operation of the signal amplifier 130 and the real potential of the sub-pixel unit of the display panel is determined in accordance with the strength of the received signal.

In the second embodiment as shown in FIG. 3 provided by the present disclosure, turning on/off of the second TFT NT2 is controlled by the reverse clock signals on the reverse clock signal lines TCK1, TCK2, TCK3, TCK4, TCK5 and TCK6.

Figure 10:
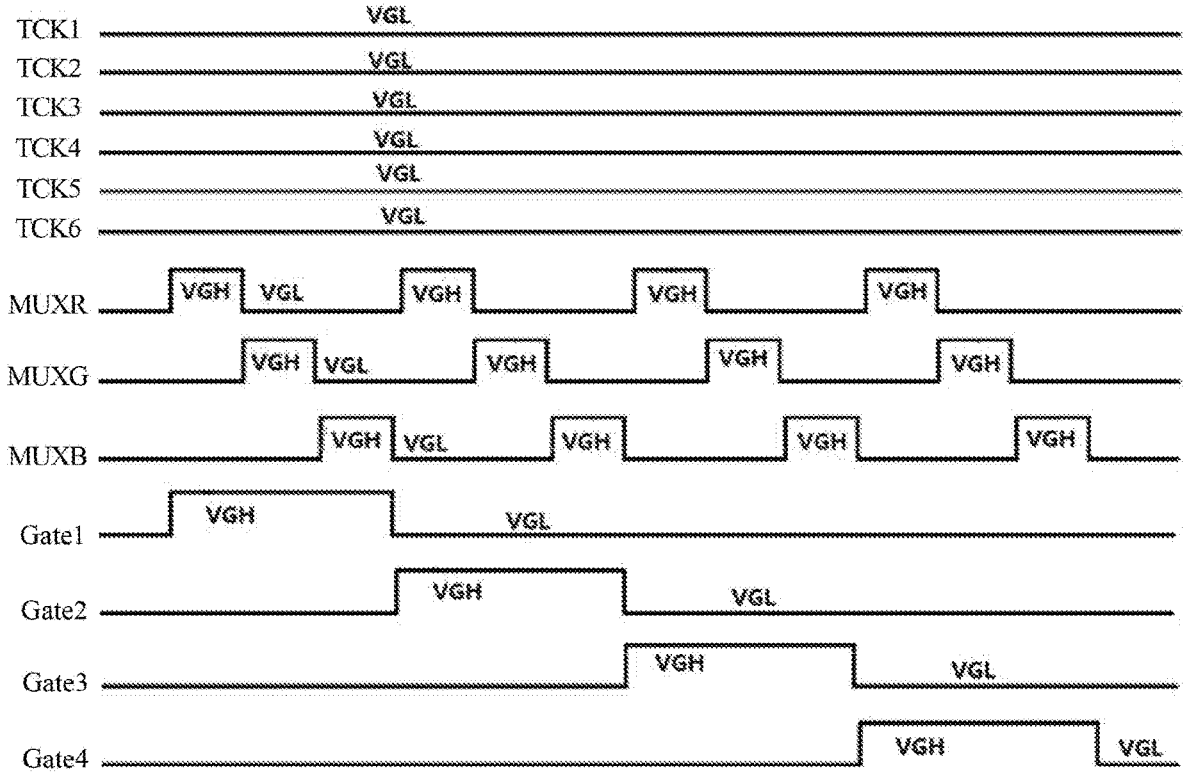
FIG. 10 is a timing sequence of the display panel when the display panel functions normally in the second embodiment of the present disclosure.

As shown in FIG. 10, which is a timing sequence of the display panel when the display panel functions normally in the second embodiment of the present disclosure. When the display panel functions normally, the signals on the reverse clock signal lines TCK1, TCK2, TCK3, TCK4, TCK5 and TCK6 are kept at low potential VGL to prevent the normal function of the display panel from being affected by the circuit of the multiplexed output selector 110, so that the circuit of the multiplexed output selector 110 is not functioned while the display panel is normally driven.

Figure 11:
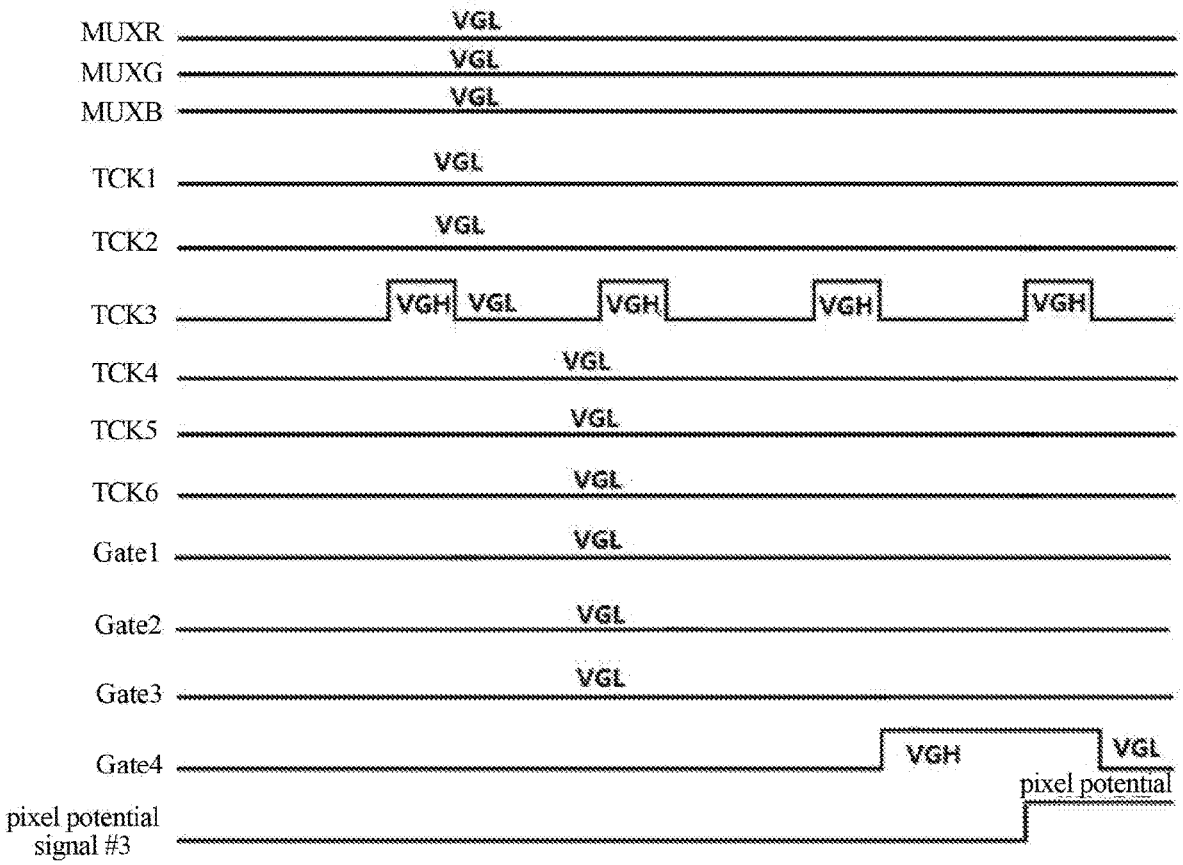
FIG. 11 is a timing sequence of the display panel when the pixel potential of the pixel thin film transistor NT210 is detected in the second embodiment of the present disclosure.

As shown in FIG. 11, which is a timing sequence of the display panel when the pixel potential of the pixel thin film transistor NT210 is detected in the second embodiment of the present disclosure. In order to understand the real potential of the sub-pixel unit comprising the pixel TFT NT210 in FIG. 3, the low potential VGL is provided to the gate lines Gate1, Gate2 and Gate3 and the sub-pixel on/off control signal lines MUXR, MUXG and MUXB, and the gate line Gate 4 is turned on alone in the first. At this time, the reverse clock signal line TCK3 of the multiplexed output selector 110 is at high potential VGH and the reverse clock signal lines TCK1, TCK2, TCK4, TCK5 and TCK6 are at low potential VGL, so that the potential of the sub-pixel unit corresponding to the pixel TFT NT210 in FIG. 3 is conducted, under the driving sequence, to the pixel potential signal #2 for driving the detection circuit 120 to work, so that the received test signal is converted to be the received signal by operation of the signal amplifier 130 and the real potential of the sub-pixel unit of the display panel is determined in accordance with the strength of the received signal.

Therefore, the present disclosure realizes measuring the real potential of the sub-pixel unit of the display panel accurately and providing convenience of problem analyzing and production designing through adding the multiplexed output selector 110 controlled by at least one reverse clock signal line set, the detection circuit 120 and the signal amplifier 130 accompanied with driving of the circuit of the display panel.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. A circuit for detecting pixel potential of a display panel, comprising a multiplexed output selector, at least one detection circuit and at least one signal amplifier; wherein, the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal;

the first terminal of each the first TFT of the circuit for detecting a pixel potential of the display panel is one of a source terminal and a drain terminal, the second terminal of each the first TFT is another one of the source terminal and the drain terminal, and the third terminal of each the first TFT is a gate terminal.

2. The circuit for detecting pixel potential of the display panel according to claim 1, wherein the multiplexed output selector comprises N reverse clock signal line sets and a plurality of second TFT's connecting to the first data line of the display panel, respectively, and each reverse clock signal line set comprises three reverse clock signal lines;

every adjacent 3*N second TFT's in the display panel are connected to different reverse clock signal lines of the N reverse clock signal line sets, respectively;

each the first TFT is correspondingly connected to adjacent 3*N second TFT's;

wherein, N≥1, a first terminal of each of the second TFT's is connected to the third terminal of the first TFT, a second terminal of each of the second TFT's is connected to the first data line of the display panel, and a third terminal of each of the second TFT's is connected to one of the reverse clock signal lines.

3. The circuit for detecting pixel potential of the display panel according to claim 2, wherein an amount of the first data line of the display panel is set to M, an amount of the detection circuit and an amount of the signal amplifier are both smallest integers greater than or equal to M/(3*N) and the first TFT is connected one-by-one to the signal amplifier.

4. The circuit for detecting pixel potential of the display panel according to claim 2, wherein each the first TFT and the second TFT's are N-channel TFT's.

5. The method for detecting pixel potential of the display panel, wherein, when the display panel comprises the circuit for detecting pixel potential of the display panel as claimed in claim 4, step of turning off the pixel TFT's except the pixel TFT of the currently-detected sub-pixel unit of the display panel through the gate lines and the sub-pixel control signal, and transmitting the potential signal of the currently-detected sub-pixel unit to the first TFT by controlling the multiplexed output selector by the reverse clock signal comprises:

controlling a selected one of the gate lines connected to the pixel TFT of the currently-detected sub-pixel unit to be at high potential, and the gate lines except the selected gate line to be at low potential;

controlling a selected one of the reverse clock signal lines connected to the pixel TFT of the currently-detected sub-pixel unit to be at high potential, and the reverse clock signal lines except the selected reverse clock signal line to be at low potential; and controlling the sub-pixel control signal on each of the three sub-pixel on/off control signal lines to be at low potential.

6. The circuit for detecting pixel potential of the display panel according to claim 1, further comprising a signal analyzing module; wherein the signal analyzing module is connected to the signal amplifier, and is configured to receive the received signal output from the signal amplifier and determine a pixel potential of the currently-detected sub-pixel unit in accordance with a strength of the received signal.

7. A display panel, comprising a pixel driving circuit and a circuit for detecting a pixel potential of the display panel; wherein the circuit for detecting the pixel potential of the display panel comprises a multiplexed output selector, at least one detection circuit and at least one signal amplifier;

the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal; the pixel driving circuit comprises a plurality of first data lines, a plurality of gate lines and three sub-pixel on/off control signal lines, and the first data lines are crossed with the gate lines to form a matrix structure; and a square area defined by adjacent two of the first data lines and adjacent two of the gate lines is a sub-pixel unit, each the sub-pixel unit comprises a pixel TFT, a first terminal of the pixel TFT is connected to a selected one of the first data lines which is adjacent to the pixel TFT, a third terminal of the pixel TFT is connected to a selected one of the gate lines which is adjacent to the pixel TFT, and at most one pixel TFT is simultaneously connected to the crossed first data line and scan line;

each of the first data lines is connected to one of the sub-pixel on/off control signal lines through a third TFT, and every adjacent three of the first data lines are connected to different three of the sub-pixel on/off control signal lines, respectively;

wherein, a third terminal of the third TFT is connected to one of the sub-pixel on/off control signal lines, a first terminal of the third TFT is connected to one of the first data lines, and three second terminals of adjacent three of the third TFT's are connected to a second data line;

each of the first terminals of the TFT's of the circuit for detecting the pixel potential of the display panel and the pixel driving circuit is one of a source terminal and a drain terminal, each of the second terminals of the TFT's is another one of the source terminal and the drain terminal, and each of the third terminals of the TFT's is a gate terminal.

8. The display panel according to claim 7, wherein the TFT's of the pixel driving circuit are N-channel TFT's.

9. The display panel according to claim 8, wherein, when the display panel functions, the reverse clock signal used in the circuit for detecting the pixel potential of the display panel is at low potential.

10. The display panel according to claim 7, wherein the multiplexed output selector comprises N reverse clock signal line sets and a plurality of second TFT's connecting to the first data line of the display panel, respectively, and each reverse clock signal line set comprises three reverse clock signal lines;

every adjacent 3*N second TFT's in the display panel are connected to different reverse clock signal lines of the N reverse clock signal line sets, respectively;

each the first TFT is correspondingly connected to adjacent 3*N second TFT's;

wherein, N≥1, a first terminal of each of the second TFT's is connected to the third terminal of the first TFT, a second terminal of each of the second TFT's is connected to the first data line of the display panel, and a third terminal of each of the second TFT's is connected to one of the reverse clock signal lines.

11. The display panel according to claim 10, wherein an amount of the first data line of the display panel is set to M, an amount of the detection circuit and an amount of the signal amplifier are both smallest integers greater than or equal to M/(3*N) and the first TFT is connected one-by-one to the signal amplifier.

12. The display panel according to claim 10, wherein the first TFT's and the second TFT's are all N-channel TFT's.

13. The display panel according to claim 7, further comprising a signal analyzing module; wherein the signal analyzing module is connected to the signal amplifier, and is configured to receive the received signal output from the signal amplifier and determine a pixel potential of the currently-detected sub-pixel unit in accordance with a strength of the received signal.

14. A method for detecting pixel potential of a display panel, which is applied in the display panel; wherein the display panel comprises a pixel driving circuit and a circuit for detecting a pixel potential of the display panel;

the circuit for detecting the pixel potential of the display panel comprises a multiplexed output selector, at least one detection circuit and at least one signal amplifier;

the detection circuit comprises a first thin film transistor (TFT), a first terminal of the first TFT receives a test signal, a second terminal of the first TFT is connected to the signal amplifier, and a third terminal of the first TFT is connected to the multiplexed output selector;

the multiplexed output selector is connected to a first data line of the display panel and the detection circuit, and is configured to selectively conduct the first data line, which is connected to a currently-detected sub-pixel unit, to the first TFT in accordance with a reverse clock signal to transmit a pixel potential signal of the currently-detected sub-pixel unit to the first TFT to control the first TFT to transmit the test signal to the signal amplifier;

the signal amplifier is configured to receive and amplify the test signal to obtain and output a received signal; the pixel driving circuit comprises a plurality of first data lines, a plurality of gate lines and three sub-pixel on/off control signal lines, and the first data lines are crossed with the gate lines to form a matrix structure; and a square area defined by adjacent two of the first data lines and adjacent two of the gate lines is a sub-pixel unit, each the sub-pixel unit comprises a pixel TFT, a first terminal of the pixel TFT is connected to a selected one of the first data lines which is adjacent to the pixel TFT, a third terminal of the pixel TFT is connected to a selected one of the gate lines which is adjacent to the pixel TFT, and at most one pixel TFT is simultaneously connected to the crossed first data line and scan line;

each of the first data lines is connected to one of the sub-pixel on/off control signal lines through a third TFT, and every adjacent three of the first data lines are connected to different three of the sub-pixel on/off control signal lines, respectively;

wherein, a third terminal of the third TFT is connected to one of the sub-pixel on/off control signal lines, a first terminal of the third TFT is connected to one of the first data lines, and three second terminals of adjacent three of the third TFT's are connected to a second data line; each of the first terminals of the TFT's of the circuit for detecting the pixel potential of the display panel and the pixel driving circuit is one of a source terminal and a drain terminal, each of the second terminals of the TFT's is another one of the source terminal and the drain terminal, and each of the third terminals of the TFT's is a gate terminal;

the method for detecting pixel potential of the liquid crystal comprises steps of:

turning off the pixel TFT's except the pixel TFT of the currently-detected sub-pixel unit of the display panel through the gate lines and a sub-pixel control signal, and transmitting a potential signal of the currently-detected sub-pixel unit to the first TFT by controlling the multiplexed output selector by the reverse clock signal;

controlling, by the potential signal of the currently-detected sub-pixel unit, the first TFT to transmit the test signal to the signal amplifier;

amplifying the test signal by the signal amplifier to obtain the received signal; and determining a pixel potential of the currently-detected sub-pixel unit in accordance with the received signal.

* * * * *